US005174851A

United States Patent [19]

Zodrow et al.

[11] Patent Number: 5,174,851

[45] Date of Patent: Dec. 29, 1992

[54] LABELLING MACHINE FOR LABELLING CONTAINERS, SUCH AS BOTTLES

[75] Inventors: Rudolf Zodrow; Rainer Buchholz, both of Düsseldorf; Wolfgang Rogall, Wuppertal, all of Fed. Rep. of Germany

[73] Assignee: KHS Eti-Tec Maschinenbau GmbH, Erkrath, Fed. Rep. of Germany

[21] Appl. No.: 694,436

[22] Filed: May 1, 1991

[30] Foreign Application Priority Data

May 1, 1990 [DE] Fed. Rep. of Germany ..... 4013983

[51] Int. Cl.[5] ..... B65C 9/00

[52] U.S. Cl. ..... 156/357; 156/566; 156/567; 156/568

[58] Field of Search ..... 156/357, 475, 486, 566, 156/567, 568

[56] References Cited

U.S. PATENT DOCUMENTS 2,956,612 10/1960 Gaines et al. ..... 156/521 X
3,472,722 10/1969 Hutchinson ..... 156/566 X
4,331,498 5/1982 Pagay et al. ..... 156/567 X
4,388,143 6/1983 Buchholz et al. ..... 156/475
4,512,842 4/1985 Schneider ..... 156/357
4,721,544 1/1988 Zodrow et al. ..... 156/456

*Primary Examiner*—David A. Simmons
*Assistant Examiner*—James J. Engel, Jr.
*Attorney, Agent, or Firm*—Nils H. Ljungman and Associates

[57] ABSTRACT

This invention relates to a labelling machine, and more particularly to a labelling machine for applying labels to containers in such a manner that the labels constitute visible proof that the containers have not been opened. One such type of container is a beverage bottle having a screw-top closure. Before the label is applied to the container, a verification is conducted on the transport path of the container to determine whether the container to be labelled has a correct closure and also to determine whether there is a label correctly positioned to be transferred to the container.

15 Claims, 5 Drawing Sheets

LABELLING MACHINE FOR LABELLING CONTAINERS, SUCH AS BOTTLES

BACKGROUND OF THE INVENTION

1. Field of the Invention

This invention relates to a labelling machine for the placing of labels onto containers, in particular, to the placing of labels onto containers in such a manner that the label constitutes visible proof that the container has not been opened. One such type of container is a beverage bottle which has a screw-top closure. A labelling machine of this type generally comprises a labelling station with a gripper cylinder for applying labels to separable sections of the containers, and a turntable equipped with an inlet star wheel and an outlet star wheel, each of which has receptacles for moving the containers, into, along and out of the labelling machine.

2. Background Information

For reasons of safety, containers which are filled with food or drink, and in particular beverage bottles which have reclosable tops, such as screw-top or snap-top closures, must meet the requirement of constituting visible proof that the bottle has not been opened after the bottle has been filled with a beverage and sealed. Thus, the consumer can visually determine whether the bottle has been opened after the original closing by the bottler.

For snap-top bottles, this protection is achieved by means of a tear strip, which is glued onto the container below the snap-top, while for screw-top bottles, there is generally a plastic or metal ring on the bottom edge of the screw-top, which ring breaks off from the rest of the top when the bottle is opened. However, this very effective means of protection of the screw-top is more expensive than the protection given by the tear strip used for snap-top bottles. This ring, when made of metal, also has the additional disadvantage that when the bottle is opened, sharp edges may be left on the ring, which sharp edges represent a potential source of injury to the user. Because of the above-mentioned shortcomings for screw-top closures, efforts are currently being directed towards protecting even screw-top closures with a strip label.

On a known labelling machine, an applicator element exists for applying hot adhesive to a reserved area of the label. This reserved area does not receive the wet adhesive that is applied to the remainder of the label. The application element itself, is designed as a roller and is located on the gripper cylinder. Thus, the hot adhesive is applied in a single rolling process to the reverse side of the label being held by the gripper cylinder. The label, to which cold, or wet adhesive, and also hot adhesive have been applied, is then transferred from the gripper cylinder to a container being moved past the gripper cylinder, whereby the label is pressed onto both the closure of the container and also onto the portion of the container directly below the closure. The section of the label that is attached to the closure is preferably the only section that receives the hot adhesive. If necessary, adjustable pressure mechanisms can also be used to assist in the pressing process. This type of labelling for containers, however, has a series of disadvantages, as enumerated below.

1. If there is no label in the gripper cylinder, the pressure pad designed to support the reverse side of the label will receive the application of adhesive from the applicator roller as the roller rolls over the pad. This can lead to disruptions during the rest of the labelling operation, because the subsequent labels will stick to, and often remain stuck to the pressure pad of the gripper cylinder, and therefore will no longer be transferred to the bottles which are being labelled.

2. The hot adhesive applied to the reserved area of the label reduces the rigidity of the label, so that as the label continues its travel to the transfer point on the turntable, it has a tendency to curl. A perfect transfer to the bottle closure is then essentially impossible.

3. When the pre-glued label is pressed against the closure of the bottle, the hot adhesive is generally no longer at a high enough temperature to achieve an optimal adhesion. Temperatures of more than 100° C. are generally required for optimal adhesion between the hot adhesive on the label and the plastic or metal closure, which metal closure is usually coated with plastic or paint.

OBJECT OF THE INVENTION

The object of the invention is therefore to create a labelling machine of the type described above, in which the labels adhere in optimal fashion to the bottle closures, and in which disruptions in the application of labels cannot occur as a result of improper application of hot adhesive.

SUMMARY OF THE INVENTION

This object is achieved by means of the present invention, in which the hot adhesive applicator element is located, in the direction of transport of the containers, before the site of the transfer of the label onto the containers. This adhesive applicator is preferably designed for pulsed activation to thereby directly apply hot adhesive to preferably only the closure on the container, or bottle. Also located in the transport direction of the containers, and ahead of the applicator element and/or also ahead of a bottle transport apparatus (inlet star wheel, feed conveyor), there is a sensing element of a control apparatus for the applicator element, which sensing element responds to the presence of a closure correctly positioned on a container. This sensing element operates synchronously with the other elements and activates the applicator element as a bottle in a turnable receptacle passes by, thereby execute the pulsed delivery of hot adhesive to this bottle only if the sensing element has detected a correctly positioned closure on the bottle.

Preferably, in combination with the above-mentioned sensing and applicator elements, but also as an alternative to it, the object of the invention is achieved by means of the fact that on the gripper cylinder, there can be an additional sensing element of a control apparatus for the applicator element, which sensing element detects the presence of correctly held labels on the gripper cylinder. When a container passes the applicator element, the control apparatus activates the pulsed delivery of hot adhesive to this container, only if this additional sensing element has determined the pressure of a label on the gripper cylinder, which label is intended to be applied to the container.

If such control were not available when a label was not present to be applied, the pressure element that normally would press a label into place would merely press into hot adhesive, since there would be no label present on the bottle. Thereby, the pressure element would pick up hot adhesive onto its pressure pads or rollers. Further usage of this now soiled pressure element for labels on subsequent bottles would transfer adhesive to the outside surface of properly applied labels thereby ruining these labels as well.

In place of the control of the pulsed delivery of hot adhesive, another alternative would be to control the pressure mechanism that would press into the adhesive on the closure when a label is not present. Such a pressure mechanism is essentially activated in pulsed fashion against the container itself to press the label onto the container. However, in cases when a label is not applied, or is incorrectly applied, so that the adhesive is exposed, the pressure mechanism would not be activated, and thus, the pressure mechanism would not contact the adhesive which has been applied to the bottle.

In the labelling machine according to the invention, the above-mentioned disruptions on account of improper hot adhesive transfer to the container or to its closure when no label is present, and/or to the pressure mechanism of the gripper cylinder for the closure area of the label are substantially prevented. These types of disruptions are substantially prevented since the hot adhesive application does not take place onto a label on the gripper cylinder, but takes place instead directly onto the bottle closures of bottles on the turntable. Also, the natural rigidity of the closure area of the label reserved from the cold adhesive application is essentially not adversely affected, and the label therefore essentially cannot curl, so that the label can be transferred to the container under substantially optimal conditions.

Moreover, on account of the direct application of the hot adhesive to the closure, the hot adhesive can essentially be applied at a temperature which is optimal for the adhesion of the label to the closure. The cooling time of the hot adhesive on the closure until the label is pressed onto the adhesive is essentially not critical under this type of arrangement, because a significantly lower temperature is required for a proper connection between the hot adhesive and the label than for a connection between the hot adhesive and the closure.

Although the activation of the applicator element for the pulsed delivery of hot adhesive is primarily dependent on the presence of correctly positioned closures, the object of the invention may be optimally achieved if the control apparatus also takes into consideration the presence of correctly extracted labels. Consideration of this label presence means that hot adhesive will not be transferred to the bottle by contact of the bottle with a pressure mechanism that has picked up adhesive from a bottle that was not carrying a label. Without a label present, the pressure mechanism would ultimately receive the adhesive, and which adhesive would consequently be transferred to the bottle and thereby soil the bottle and make it unusable. Of the two alternatives, the alternative with the activation of the applicator element is preferred, because it requires less in the way of design effort, expense and complexity.

The sensing element which verifies the presence of a properly positioned closure responds both in the event of a missing closure on a container, and in the event of a missing container, because then there is obviously no closure. This verification, which, as described above, can be made on the turntable, could also be made on an upstream transport line, either in or near the inlet star wheel, which is driven synchronously with the turntable, or on a feed conveyor driven synchronously with the turntable, because from the inlet star wheel through the outlet star wheel, the position of the individual containers can be closely monitored. If a disruption should occur after this initial verification of the presence of the closure is performed, and the closure is no longer in the predetermined position when it reaches the application point for the hot adhesive, another configuration of the invention makes it possible to prevent the application of hot adhesive by means of an additional verification at, or as close as possible to, the application point.

According to this last configuration, the labelling machine may have grip heads located on the turntable, which grip heads can essentially be lowered axially to the bottles by means of a cam control, and in which configuration there may be a compensating spring or other form of biasing element between the grip heads and the corresponding grip-head engagement elements. Each grip head can then comprise a transmitter for a sensing element of the control apparatus located ahead of, or at, the application point for the hot adhesive. When the bottle is in the correct position, this sensing element activates the applicator element for the pulsed discharge of hot adhesive. This activation occurs only in the sense of a logical decoupling from the other activations, but as a function of the other verifications.

If the pressing of the label onto the bottle closure by the gripper cylinder, which generally takes place by a radial, pulse-activated pressure element, is insufficient, one configuration of the invention specifies that the pressing can be supplemented or completed in the outlet star wheel. To protect the pressing element from an unintentional transfer of adhesive from the closure to the pressing element, even in cases where there is no label coated with adhesive in the vicinity of the closure for any reason whatsoever, the pressure element in the outlet star wheel, in one configuration of the invention, may preferably be transferred from an outer radial work position into an inner radial idle position by an interposable control cam, whereby for the interposition of the control cam, there is a control apparatus with a sensing element which responds to the presence of labels on the closure of the container in the outlet star wheel. If the label is missing, the control cam essentially acts to move the pressure element into the idle position.

In summary, one aspect of the invention resides broadly in an apparatus for applying at least one label to a container, the apparatus comprising: a device for supporting the container during the applying of the at least one label; a device for applying adhesive to at least one of: at least a portion of the container, and at least a portion of the at least one label; at least one labelling station for applying the at least one label to the container; a device for providing relative movement between the container and the at least one labelling station; an inlet device for providing containers to be labelled to the device for providing relative movement; an outlet device for removing containers after labelling from the device for providing relative movement; a first sensor for detecting a presence of the container to be labelled; and a device for activating the device for applying adhesive to apply adhesive to the at least one of: the at least a portion of the container, and the at least a portion of the at least one label, upon the first sensor detecting the presence of the container to be labelled.

Another aspect of the invention resides broadly in a method for applying labels to bottles having screw-top closures by using a labelling machine, the labelling machine comprising: a device for supporting the bottle during the applying of the at least one label; a device for applying adhesive to at least one of: at least a portion of the bottle, and at least a portion of the at least one label; at least one labelling station for applying the at least one label to the bottle; a device for providing relative movement between the bottle and the at least one labelling station; an inlet device for providing bottles to be labelled to the device for providing relative movement; an outlet device for removing bottles after labelling from the device for providing relative movement; a first sensor for detecting a presence of a bottle to be labelled; a device for activating the device for applying adhesive to apply adhesive to the at least one of: the at least a portion of the bottle, and the at least a portion of the at least one label, upon the first sensor detecting the presence of the bottle to be labelled; the method comprising the steps of: positioning the bottle to be labelled onto the means for providing relative movement; providing relative movement between the bottle and the at least one labelling station; sensing the presence of the bottle with the first sensor; activating the device for applying adhesive with the device for activating to thereby apply adhesive to the at least one of: the at least a portion of the bottle, and the at least a portion of the at least one label; applying the at least one label to the bottle by affixing the label to the bottle at the at least one labelling station; and removing the bottle from the device for providing relative movement.

One additional aspect of the invention resides broadly in an apparatus for applying at least one label to a container, the apparatus comprising: a device for supporting the container during the applying of the at least one label; a device for applying adhesive to at least one of: at least a portion of the container, and at least a portion of the at least one label; at least one labelling station for applying the at least one label to the bottle, the at least one labelling station comprising a label supply device for supplying the at least one label, a label gripping device for affixing the at least one label to the container, and a device for transporting the at least one label from the label supply device to the label gripping device; a device for providing relative movement between the container and the at least one labelling station; an inlet device for providing containers to be labelled to the device for providing relative movement; an outlet device for removing containers after labelling from the device for providing relative movement; a first sensor for detecting a presence of the at least one label on the label gripping means; and means for activating the means for applying adhesive to thereby apply adhesive to the at least one of: the at least a portion of the container, and the at least a portion of the at least one label, upon the first sensor detecting the presence of the at least one label on the label gripping device.

BRIEF DESCRIPTION OF THE DRAWINGS

The invention is explained in greater detail below on the basis of an embodiment which is illustrated in the accompanying drawings, in which.

DESCRIPTION OF THE PREFERRED EMBODIMENTS

Figure 1:
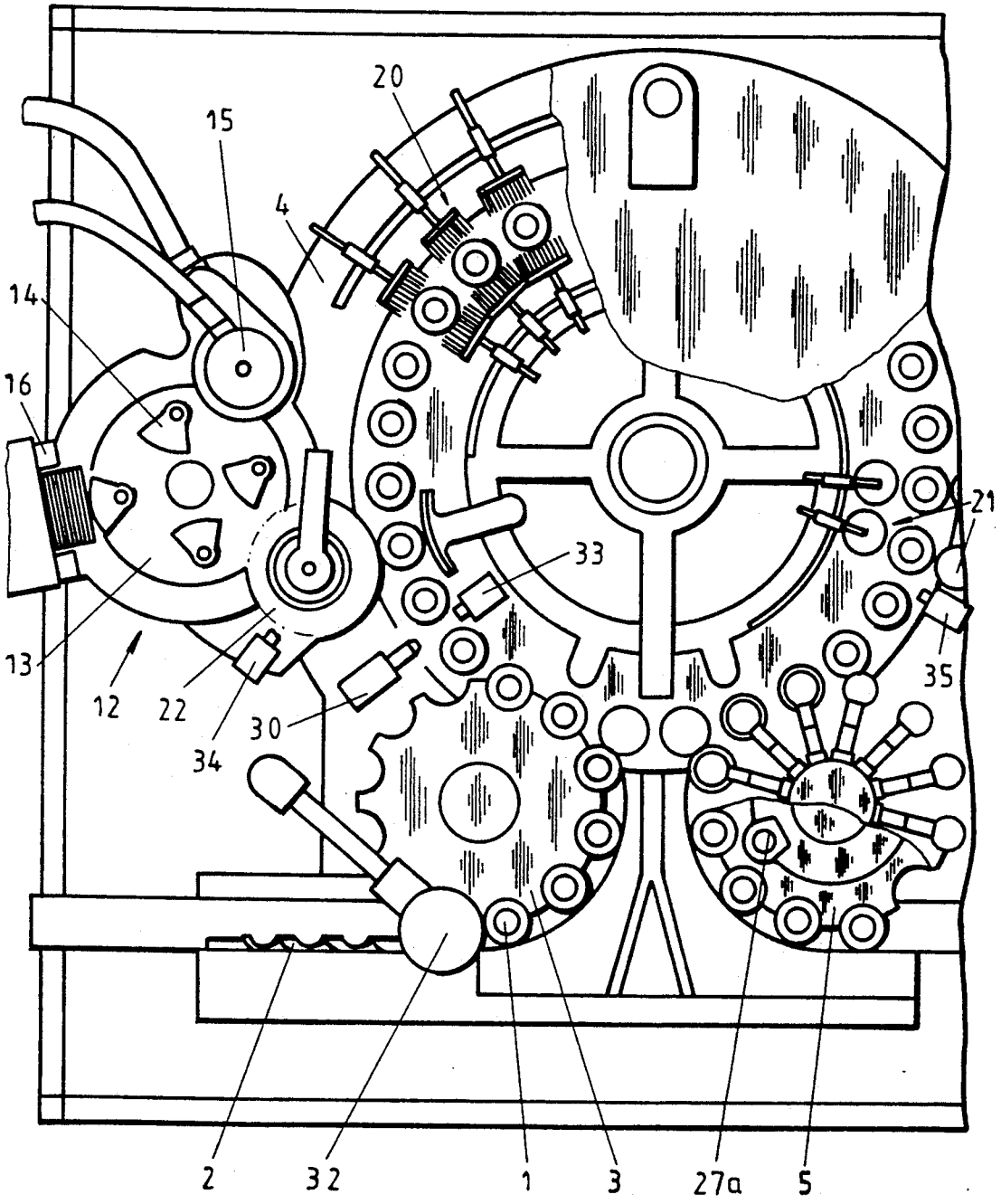
FIG. 1 shows a schematic plan view of a labelling machine.

The labelling machine illustrated in FIG. 1 for labelling containers, in particular for labelling bottles 1 with screw-top closures, has a feed conveyor 2 for transport of the bottles 1, an inlet star wheel 3 for moving the bottles from the feed conveyor 2 to the labelling machine, a turntable 4 for carrying the bottles on the labelling machine, and an outlet star wheel 5 for removing the bottles from the labelling machine to another feed conveyor (not shown). These parts, 2 through 5, are synchronously driven and have receptacles thereon for receipt of the bottles, so that a bottle 1 entering the feed conveyor 2 can be tracked with regard to its position during its transport throughout the labelling machine.

Figure 2:
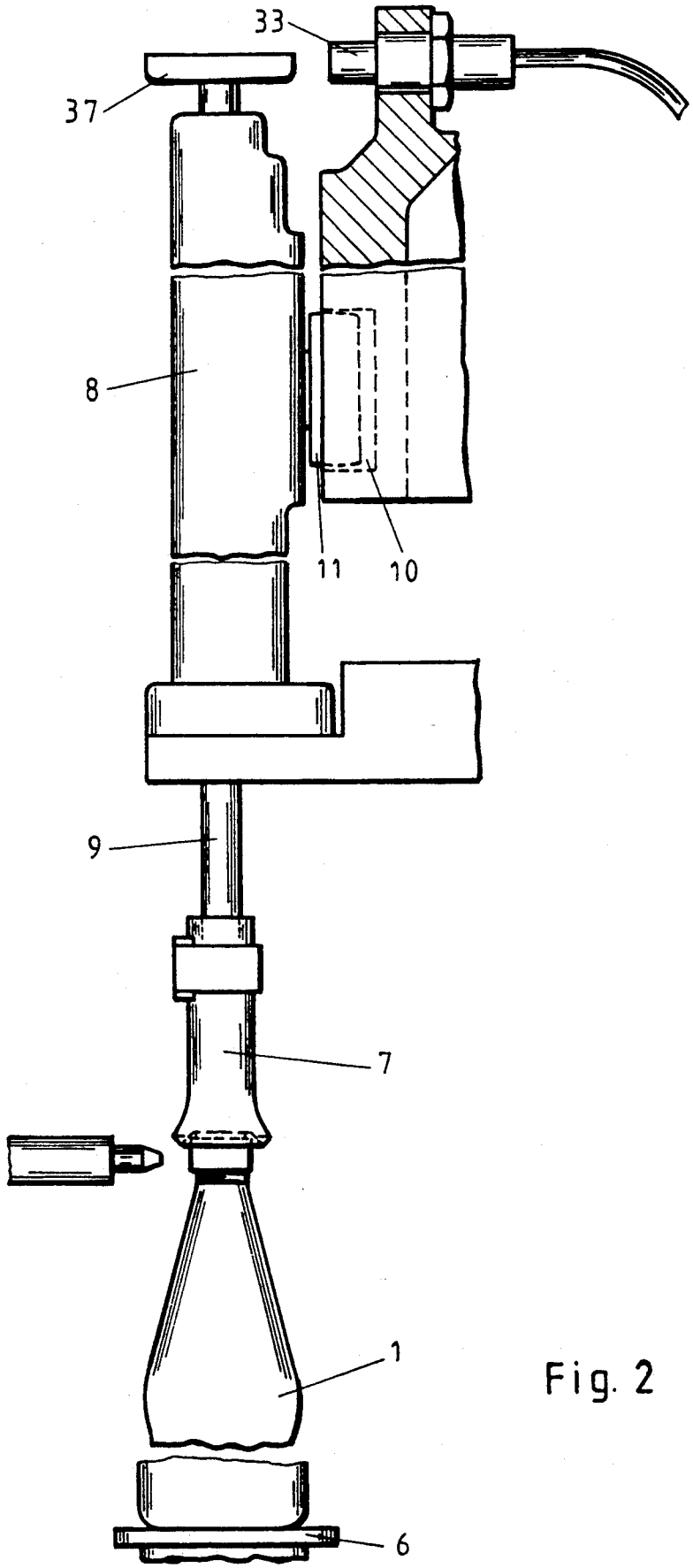
FIG. 2 shows a detailed view of an axial cross section of the application mechanism for hot adhesive.

As FIG. 2 shows, in the turntable 4, there is preferably a rotary plate 6 and a grip head 7 for each receptacle of turntable 4. The bottle 1 may then preferably be axially braced between the rotary plate 6 and the grip head 7. The grip head 7 may be supported by a rod 9, which rod 9 can preferably move axially within a housing 8, and which rod 9 can preferably be moved axially against the bottle 1 by an engagement element 11 guided in a stationary control cam 10, with the interposition of a spring (not shown) located in the housing 8. The spring therefore essentially acts as a compensation spring and constitutes the axial bracing force.

About the circumference of the turntable 4, the labelling machine comprises at least one labelling station 12, which labelling station 12 may essentially comprise a rotating support 13 having powered extractor elements 14 positioned thereon. These extractor elements 14 preferably either rotate or pivot on the support 13 to pick up and deliver labels from a label supply station 16 to a gripper cylinder 22. The labelling station 12 also preferably comprises an adhesive roller 15. In such a labelling station 12, labels are preferably removed from the label supply 16 by the extractor elements 14. The extractor elements 14 then preferably carry the labels to the adhesive roller 15, where wet adhesive is applied to the reverse side of the labels.

Figure 5:
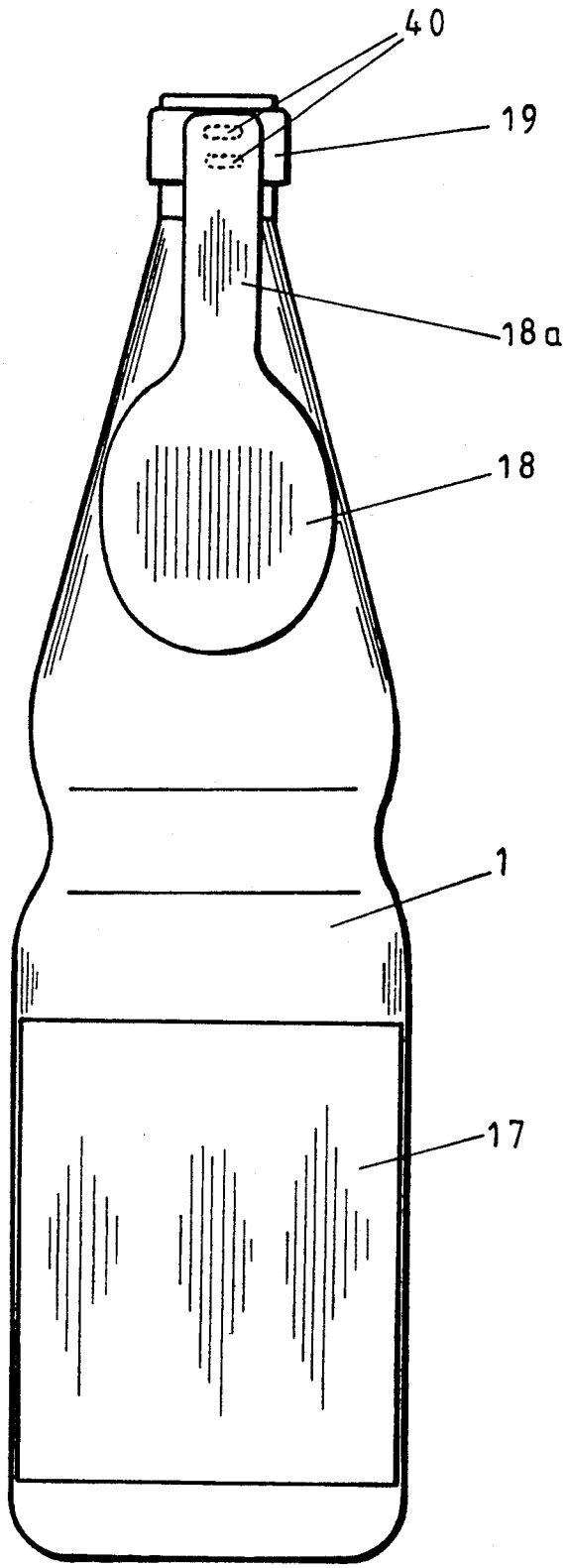
FIG. 5 shows a side view of a bottle with a label applied to the neck and closure of the bottle.

Preferably, the adhesive roller 15 does not apply adhesive to the area of the labels which will later be fastened to the closure of the bottle. The bottle 1, illustrated in FIG. 5, shows a body label 17 and a neck label 18, the neck label having a strip 18*a* extending upwardly to be affixed to the closure 19. The body label 17 and the neck label 18, with the exception of the strip 18*a*, are preferably provided with cold adhesive from adhesive roller 15. The labels 17, 18, to which adhesive has been applied in this manner, are then preferably transferred by means of the gripper cylinder 22 to the bottles 1 as the bottles are transported past the gripper cylinder 22.

The labelling machine may also have stationary brushes 20 and pressure rollers 21 positioned substantially adjacent the turntable, so that as the bottles 1, with the labels 17, 18 attached according to the process discussed above, are further transported, the bottles 1 can possibly first move past the stationary brushes 20. The rotary plates 6 rotate the bottles around their own axes, so that pressure can be applied over the entire surface of the labels 17, 18 to press the labels onto the bottles 1. As the bottles are transported further, the bottles can then reach stationary pressure rollers 21, where the labels 17, 18 can be further pressed and smoothed onto the bottle 1. The labelled bottles then preferably leave the labelling machine via the outlet star wheel 5.

Figure 3:
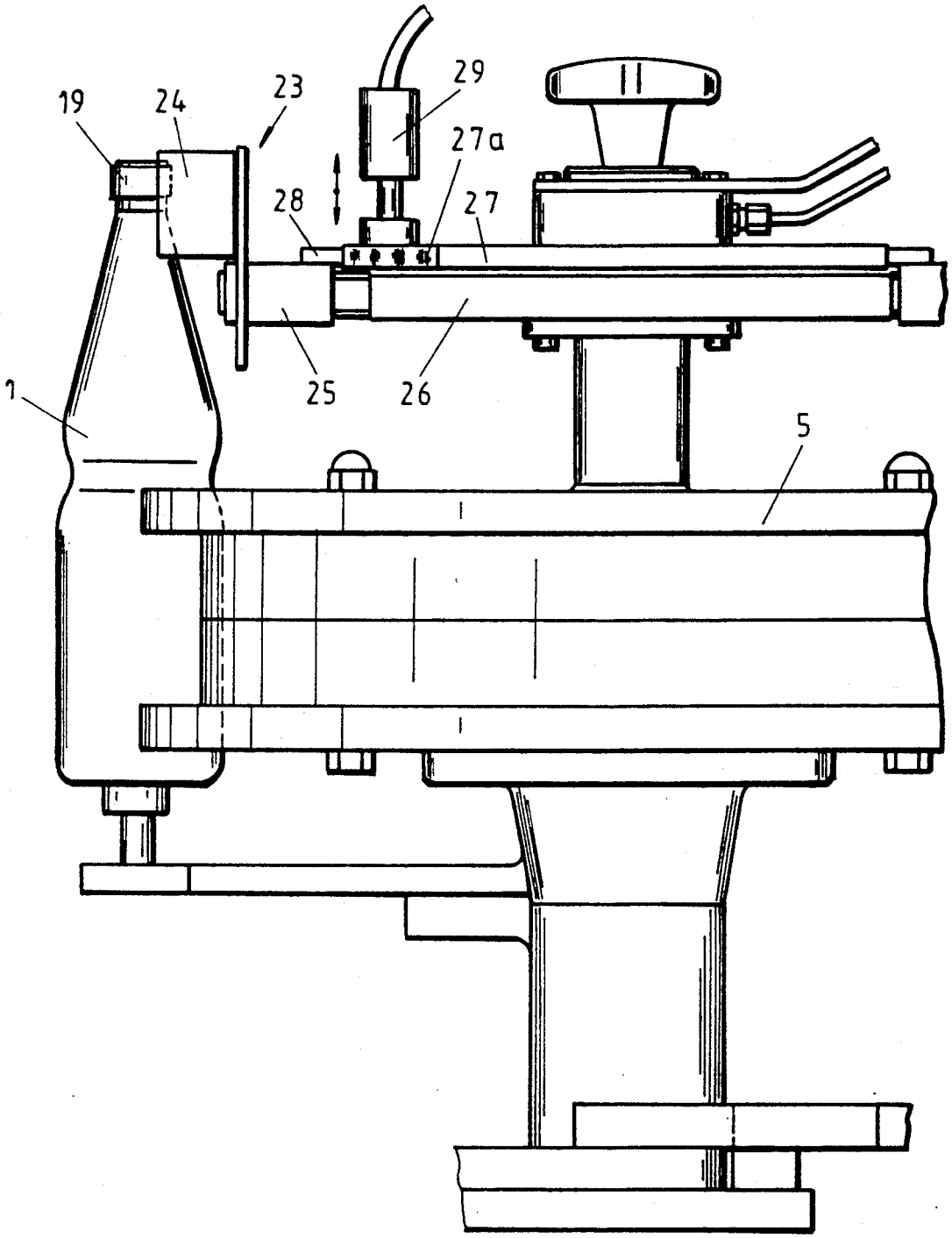
FIG. 3 shows a detailed view of an axial cross section of the outlet star wheel.

In the outlet star wheel 5, there is preferably a cam-controlled pressure element 23 for each receptacle, as shown in detail in FIG. 3. The pressure element 23 preferably consists of a support 25 equipped with a pressure pad 24, which support 25 and pad 24 are mounted, in a guide 26, against the force of a spring (not shown), which force is directed radially outward. For the radial movement of the support 25 there is preferably a cam control, which cam control may consist of a stationary cam disc 27 and an engagement element 28, preferably in the form of a roller, for each support 25. The stationary cam disc 27 can preferably have a cam 27*a*, the height of which cam 27*a* is preferably adjustable, and which cam 27*a* is preferably removable from the engagement area of the engagement element 28 by means of an actuator 29.

Cam 27*a* is preferably configured to project beyond the otherwise concentric cylindrical surface of the cam disc 27, so that, as the star wheel 5 rotates, only when the cam 27*a* is in a lower position, as illustrated in FIG. 3, does the radial activation of the pressure element 23 cause the pressure element to reach the closure 19 of the bottle.

Figure 4:
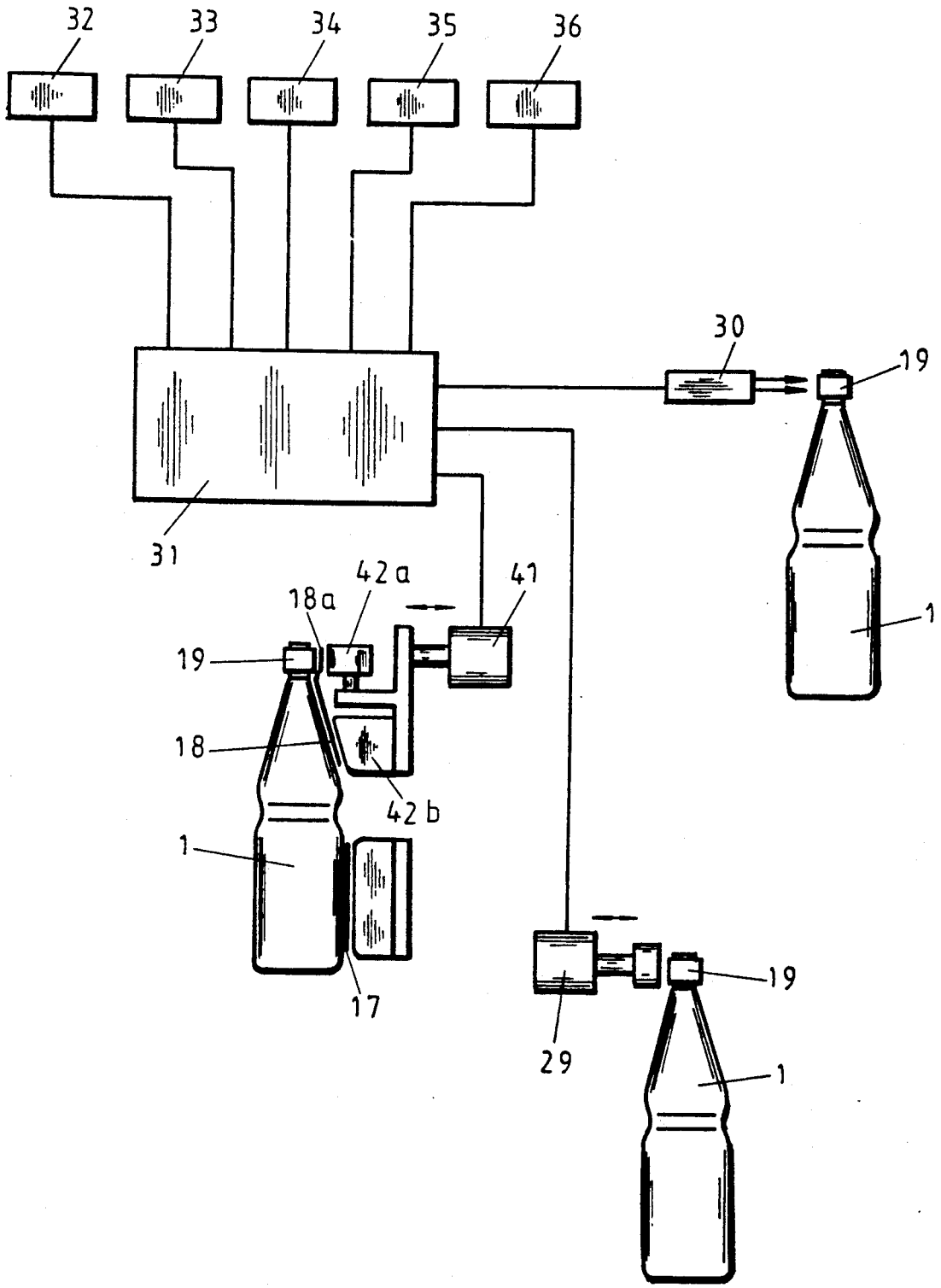
FIG. 4 shows a control apparatus for the application element in a block diagram.

Since the cold adhesive is applied to the labels 17, 18 only in the areas of the labels which will be fastened to the bottle 1, and not to the strip 18*a* for the closure 19, an applicator element 30, as shown in FIG. 4, can be positioned in stationary fashion along the circumference of the turntable 4, ahead of the location of the transfer of the labels 17, 18, and next to the gripper cylinder 22. This application element 30 is designed for the pulsed spraying of hot adhesive onto the closure 19 of the bottles 1 as the bottles 1 are transported past the application element 30. In this embodiment, there can be a control apparatus 31 for the activation of this application element 30.

In alternative embodiments, there can be various other sensing elements 32, 33, 34, 35 and 36 which constitute the control apparatus, which sensing elements can be positioned at various points throughout the labelling machine and which sensing elements may respond to various criteria. For example, the sensing element 32 may preferably be located on or near the inlet star wheel 3 and may be designed to determine whether a bottle 1 is present and/or whether the bottle 1 has a closure. The sensing element 33 may preferably be located at the hot adhesive application point, and may perform various tasks. In the simplest case, the sensing element 33 need preferably only determine the presence of bottles 1, so that at the proper time, the sensing element 33 can preferably send a signal to the control apparatus 1 for the pulsed delivery of hot adhesive to the closure 19 on the bottle top. At the same time, it may preferably verify the presence of a correctly positioned bottle having a closure thereon. This task can preferably be accomplished, as shown in FIG. 2, by means of a transmitter 37, which transmitter 37 is preferably supported by the rod 9. Sensing element 33 is preferably configured to respond to transmitter 37 only when the transmitter is in the upper position as is illustrated in FIG. 2. If, on the other hand, there is no bottle present, then the rod 9 and the transmitter 37 would preferably assume a lower position on account of the intermediate spring 8 located in the housing, and thus, the transmitter 37 would be in a position in which it would not generally be detected by the sensing element 33.

The sensing element 34 may be located on the circumference of the gripper cylinder 22 and may be designed to determine whether a label has been taken from the extraction element 14 or whether the strip 18*a* is being held in the correct position. Only when the above conditions are met, will the sensing element 34 transmit a signal to the control apparatus 31, which then allows the delivery of hot adhesive to be made.

A stationary sensing element 35 may be located along the circumference of the turntable 4, preferably a short distance before the outlet star wheel 5. This sensing element 35 may determine whether a strip 18*a* is properly adhering to the closure 19.

With regard to the above arrangement of sensors, the activation of the application element 30 for the delivery of hot adhesive by means of the control apparatus 31 preferably takes place as follows:

Only if the control apparatus 31 receives a signal from each of sensing element 32, sensing element 33, and sensing element 34 to signal the presence of a bottle with a correctly positioned closure and the presence of a label 18 with a correctly positioned strip 18*a*, does the control apparatus 31 activate the application element 30 for the delivery of hot adhesive. The hot adhesive is then preferably applied to the closure 19 in the form of two spots of adhesive 40.

The control apparatus 31 may also be configured to activate an activation element 41 of a pressure element, which pressure element preferably comprises a roller 42*a* for the strip 18*a* and a pad 42*b* for the label 18. Preferably, the roller 42*a* compensates for any tangential slippage of the strip 18*a* with respect to the closure, which slippage may occur during the label placement, so that practically no stress is exerted on the strip 18*a* in the tangential direction. If it is not guaranteed that the strip 18*a* covers the spots 40 on the closure 19 the pressure element can be alternately moved into an idle position (not shown). This alternative idle position guarantees that essentially no applied hot adhesive will contaminate the pressure roller 42*a*. If the label 18 or the strip 18*a* is missing, the pressure element is preferably not activated, and therefore, no adhesive will be transferred to the pressure element. The next label 18 in the gripper cylinder 22 is then removed from the gripper cylinder 22 in a known manner.

Since the position of the bottles 1 in the labelling machine can essentially be monitored until they enter the outlet star wheel 5, the actuator 29 for the cam 27 may preferably be activated by the control apparatus 31 as a function of the signals supplied for the bottles in the individual receptacles of the outlet star wheel 5, which signals indicate the presence of labels correctly transferred to the bottles 1. This control process essentially prevents the pressure element 24 from hitting the spots of hot adhesive 40 that were not covered by the strip 18*a*. Since malfunctions can occur as the bottles are transported through the labelling machine, even after the labels have been correctly applied, a repeat verification of the correct labelling may be performed immediately before the entry of the bottle 1 into the outlet star wheel 5 by means of the sensing element 35. If this sensing element 35 detects an error, the actuator 29 is preferably activated and the pressure element 24 is moved into an idle position (not shown). This type of activation can also take place directly, that is, independently of the control apparatus 31.

Moreover, as a function of the signal from the sensing element 35, a bottle removing loop, which is preferably located beyond the output point of the outlet star wheel 5, may be activated to remove any improperly labelled bottles.

One feature of the invention resides broadly in a labelling machine for containers, in particular bottles closed with screw-top closures. Such a labelling machine essentially has a labelling station 12 which in turn has a gripper cylinder 22 for labels 18, 18*a* to be applied to containers 1. In particular, the labels are applied on the neck of the bottle and to the closure 19. The labelling machine also usually has a turntable 4 with receptacles for the containers 1, with an inlet and outlet star wheel 3, 5. The labelling station 12 is designed for the wet application of adhesive to the label 18, reserving the region 18*a* to be applied to the closure 19, and whereby there is an applicator element 30 for the application of hot adhesive. The labelling machine is characterized by the fact that the applicator element 30 on the turntable 4 is located ahead of the transfer point for the transfer of the label 18 to the container 1, in the transport direction of the container 1. This applicator element 30 is designed for the pulsed activation and the direct transfer of hot adhesive to the closure 19. Ahead of the applicator element 30, in the transport direction of the container 1, on the turntable 4 or on the synchronously driven transport apparatus (inlet star wheel 3, feed conveyor 2) immediately ahead of the turntable 4, there is a sensing element 32, 33 of a control apparatus 31 for the applicator element. This sensing element 32, 33 responds to the presence of a closure 19 correctly positioned on the container 1 so that the control apparatus 31 activates the applicator element 30 for the pulsed delivery of hot adhesive to the bottle only if the sensing element 32, 33 has detected a correctly positioned closure 19 on this bottle.

Another feature of the invention resides broadly in a labelling machine for containers, in particular bottles, closed with screw-top closures. Such a labelling machine essentially has a labelling station 12 comprising a gripper cylinder 22 for labels 18, 18*a* to be applied to containers 1. In particular, the labels are applied to the neck of the bottle and to the closure 19. The labelling machine also usually has a turntable 4 with receptacles for the containers 1, with an inlet and outlet star wheel 3, 5, while the labelling station 12 is designed for the wet application of adhesive to the label 18, reserving a region 18*a* to be applied to the closure 19. There is also an applicator element 30 for the application of hot adhesive. This labelling machine is characterized by the fact that, located on the turntable 4 ahead of the transfer point of the label 9 to the container 1, there is a controllable applicator element 30 designed for the direct transfer of hot adhesive to the closure 19. Also, on the gripper cylinder 22, there is a sensing element 34 of a control apparatus 31 for the applicator element 30, which sensing element 34 responds to the presence of properly applied labels 18, 18*a*, so that the control apparatus 31 only activates the applicator element 30 for the pulsed delivery of hot adhesive to the bottle as a bottle passes the sensing element 34 when the sensing element 34 has detected a correctly held label 18 for this bottle. Also the control apparatus 31 may either hold a pressure element for the closure area 18*a* of the label 18 in the pressure position, or moves it into this position, only when the sensing element 34 has detected a correctly held label 18 for this bottle.

Yet another feature of the invention resides broadly in a labelling machine with grip heads 7 located in the turntable 4. The grip heads can be lowered by means of a cam control 10, 11 axially onto the container 1, and between the grip heads 7 and the corresponding engagement elements 11 of the cam control 10, 11 there is a compensation spring. Such a labelling machine is characterized by the fact that for each grip head 7 there is a transmitter 37, for a sensing element 33 of the control apparatus 31, located near or at the application site for the hot adhesive. And only if the grip head 7 is in the correct position for a correct container 1 does it activate the applicator element 30 for the pulsed delivery of hot adhesive.

A further feature of the invention resides broadly in a labelling machine characterized by the fact that in the outlet star wheel 5, for each receptacle there is a revolving pressure element 23. This pressure element 23 can be moved from an outer radial work position to an inner radial idle position by an interposable control cam 28, whereby for the interposition of the control cam 28, there is a control apparatus 31 with the sensing element 35 which responds to the presence of labels 18 on the closure 19 of the bottles to be transported into the outlet star wheel 5. If the label 18 is missing, the control cam 28 causes the pressure element 23 to be moved into the idle position.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for applying at least one strip to a container, the container having at least a first part and a second part, the first part of the container comprising a bottle and the second part of the container comprising a closure, the closure being removable from the bottle, and the strip comprising a label having a first end and a second end, the first end of the label for being applied to the bottle and the second end of the label for being applied to the closure, said apparatus comprising:

means for supporting the container during application of the at least one strip;

means for applying hot adhesive to at least a portion of the closure, said hot adhesive being for attaching the second end of the label to the removable closure;

means for applying the at least one label to the container, said means for applying the at least one label to the container comprising means for applying cold adhesive to at least a portion of the at least one label, the at least a portion of the at least one label substantially comprising the first end of the at least one label;

means for providing relative movement between the container and said means for applying the at least one label to the container;

inlet means for providing containers to the means for providing relative movement;

outlet means for removing containers from the means for providing relative movement;

first sensor means for detecting a presence of the removable closure disposed on the bottle; and means for activating said means for applying hot adhesive to apply hot adhesive to at least a portion of the closure upon at least said first sensor means detecting the presence of the removable closure disposed on the bottle.

2. The apparatus according to claim 1, wherein:

said closure comprises a screw-on cap;

said means for providing relative movement moves the bottles in a direction from said inlet means to said outlet means;

said first sensor means is disposed before said means for applying hot adhesive in the direction of movement of the bottles;

said means for applying the at least one label to the container further comprises a labelling station, said labelling station comprising:

label supply means for supplying the at least one label;

label gripping means for affixing the at least one label to the bottle;

means for moving the at least one label from said label supply means to said means for applying cold adhesive to at least a portion of the at least one label;

means for moving the at least one label from said means for applying cold adhesive to at least a portion of the at least one label to said label gripping means;

means for pressing the at least one label onto the bottle to press the label firmly onto the bottle after the at least one label is applied to the bottle, said means for pressing having a first idle position and a second pressing position;

control cam means for moving said means for pressing from said first idle position to said second pressing position;

second sensor means for detecting a presence of the at least one label on said gripping means; and means for activating:

said means for applying adhesive to the closure to thereby apply adhesive to the closure, and said control cam means for moving said means for pressing to move said means for pressing into contact with the at least one label, upon at least said second sensor means detecting the presence of the at least one label on said gripping means.

3. The apparatus according to claim 2, wherein:

said first sensor means produces a signal corresponding to the presence of the bottle to be labelled;

said second sensor means produces a signal corresponding to the presence of the at least one label on said gripping means; and said means for activating comprises control means for receiving said signals from said first and said second sensor means, said control means for activating said:

said means for applying adhesive to the closure, and said cam control means for moving said means for pressing, upon receipt of said signals from both said first and said second sensor means.

4. The apparatus according to claim 3, further including third and fourth sensor means, said third sensor means being disposed adjacent said inlet means for detecting a presence of the bottle in said inlet means and said fourth sensor means being disposed adjacent said means for providing relative movement and after said labelling station for detecting an attached at least one label on the bottle, said third sensor means for producing a signal corresponding to the presence of the bottle in said inlet means and said fourth sensor means for producing a signal corresponding to the presence of the attached at least one label on the bottle, and said control means being for receipt of said signals from said third and said fourth sensor means.

5. The apparatus according to claim 4, wherein said inlet means comprises an inlet star wheel, said outlet means comprises an outlet star wheel, and said outlet star wheel further comprises:

means for applying pressure to the label on the bottle to press the attached at least one label onto the bottle, said means for applying pressure being movably mounted on said outlet star wheel, said means for applying pressure comprising a first idle position away from the bottle and a second engaged position in contact with the bottle;

cam means movably disposed on said outlet star wheel for engaging said means for applying pressure to move said means for applying pressure from said second engaged position to said first idle position;

said cam means having a first position for engaging said means for applying pressure and a second position out of engagement with said means for applying pressure;

means for moving said cam means from said first position to said second position and from said second position to said first position; and said control means for activating said means for moving said cam means so that said means for applying pressure applies pressure to the label only upon receipt of said signal corresponding to the presence of the attached at least one label.

6. The apparatus according to claim 5, wherein:

said means for providing relative movement comprises a turntable, said turntable comprising:

a plurality of receptacles for receipt of a bottle;

means for retaining the bottle on the receptacle, said means for retaining comprising at least one gripping head;

means for moving said at least one gripping head into and out of engagement with the bottle;

biasing means for maintaining engagement of said at least one gripping head with the bottle; and transmitter means for being mounted in conjunction with said gripping head so that said transmitter means has a first position when the gripping head is in engagement with the bottle and a second position when the bottle is absent;

said first sensor means comprises means for detecting the presence of a bottle closure and means for detecting the presence of a bottle;

said first sensor means comprises said transmitter means, said transmitter means in said first position being for transmitting a signal to said control means to indicate the presence of the bottle and said transmitter means in said second position being for not transmitting a signal to the control means to indicate the absence of the bottle;

the screw-on cap comprises a threaded portion;

the bottle comprises a threaded portion for receipt of the threaded portion of the screw-on cap;

said means for moving the at least one label comprises at least one pivotable extractor element; and said apparatus further comprises:

at least one of: brushes and rollers disposed about said turntable for pressing and smoothing the at least one label onto the bottle; and a bottle extractor means positioned adjacent said outlet star wheel, said bottle extractor means for removing bottles having improperly applied labels and bottles with no labels as determined by said fourth sensor means.

7. The apparatus according to claim 1, further including second and third sensor means, said second sensor means for detecting a presence of the container and said third sensor means being disposed after said means for applying the at least one strip to the container, said third sensor being for detecting an attached at least one strip on the container, said second sensor means for producing a signal corresponding to the presence of the container and said third sensor means for producing a signal corresponding to the presence of the attached at least one strip on the container.

8. A method for applying labels to bottles having screw-top closures by using a labelling machine, the labels having a first end for being attached to the bottles and a second end for being attached to the closures, said labelling machine comprising:

means for supporting the bottle during said application of the at least one label;

means for applying adhesive to:

at least a portion of the closure, and at least a portion of the first end of the at least one label, said means for applying adhesive comprising:

first means for applying adhesive to at least a part of the first end portion of the at least one label, said first means for applying adhesive being for applying cold adhesive to the at least a part of the first end of the at least one label; and second means for applying adhesive to the at least a portion of the closure, said second means for applying adhesive being for applying hot adhesive to the at least a portion of the closure;

at least one labelling station for applying the at least one label to the bottle and closure;

means for providing relative movement between the bottle and said at least one labelling station;

inlet means for providing bottles to be labelled to said means for providing relative movement;

outlet means for removing bottles after labelling from said means for providing relative movement;

first sensor means for detecting a presence of a closure on the bottle to be labelled;

means for activating said means for applying adhesive to apply adhesive to:

the at least a portion of the closure, and the at least a portion of the first end of the at least one label, upon at least said first sensor means detecting the presence of the closure on the bottle to be labelled; and said method comprising the steps of:

positioning the bottle to be labelled onto said means for providing relative movement;

providing relative movement between the bottle and said at least one labelling station;

sensing the presence of the closure on the bottle with said first sensor means;

activating the means for applying adhesive with the means for activating to thereby apply:

hot adhesive to the at least a portion of the closure; and cold adhesive to said at least a part of the first end portion of the at least one label;

attaching the first end portion of the at least one label with adhesive thereon to the bottle;

attaching the second end of the label to the adhesive on the screw-on closure of the bottle; and removing the bottle from said means for providing relative movement.

9. Apparatus for applying at least one label to a container, the container having a first part and a second part, the first part of the container comprising a bottle and the second part of the container comprises a closure, the closure being removable from the bottle, the at least one label having a first end for being attached to the bottle and a second end for being attached to the closure, said apparatus comprising:

means for supporting the container during said application of the at least one label;

means for applying hot adhesive to at least a portion of the closure of the bottle, the hot adhesive being for adhering the second end portion of the label to the closure on the bottle;

at least one labelling station for applying the at least one label to the container, said at least one labelling station comprising:

a label supply means for supplying the at least one label;

means for applying cold adhesive to at least a portion of the at least one label, the at least a portion of the at least one label substantially comprising the first end portion of the at least one label, and the cold adhesive being for adhering the first end portion of the label to the bottle;

a label gripping means for affixing the at least one label to the container; and a means for transporting the at least one label from said label supply means to said label gripping means;

means for providing relative movement between the container and said at least one labelling station;

inlet means for providing containers to be labelled to the means for providing relative movement;

outlet means for removing containers after labelling from the means for providing relative movement;

first sensor means for detecting a presence of the at least one label on said label gripping means; and means for activating said means for applying hot adhesive and said means for applying cold adhesive to thereby apply hot adhesive to the at least a portion of the closure, and cold adhesive to the at least a portion of the first end of the at least one label, upon said first sensor means detecting the presence of the at least one label on said label gripping means.

10. The apparatus according to claim 9, further comprising:

means for pressing the at least one label onto the container to press the label firmly onto the container after the at least one label is applied to the container. said means for pressing for being disposed substantially adjacent said gripping means. said means for pressing having a first idle position and a second pressing position;

cam control means for moving said means for pressing from said first idle position to said second pressing position; and means to activate said cam control means for moving said means for pressing to move said means for pressing into contact with the at least one label upon at least said first sensor means detecting the presence of the at least one label on the gripping means.

11. The apparatus according to claim 10, further including:

second sensor means for detecting a presence of a closure on the container, said second sensor means for producing a signal corresponding to a presence of the closure on the container, and said first sensor means for producing a signal corresponding to a presence of the at least one label on said gripping means; and control means, said control means comprising said means for activating said means for applying adhesive and said means for activating said cam control means. said control means for receiving said signals from said first and said second sensor means. said control means for activating both of:

said means for applying adhesive to the container, and said cam control means for moving said means for pressing. only upon receipt of said signals from both of said first and said second sensor means.

12. The apparatus according to claim 11, further including third and fourth sensor means, said third sensor means being disposed adjacent said inlet means for detecting the presence of the container in said inlet means and said fourth sensor means being disposed adjacent said means for providing movement and after said at least one labelling station for detecting the presence of an attached label on the container, said third sensor means for producing a signal corresponding to the presence of the container in said inlet means and said fourth sensor means for producing a signal corresponding to the presence of the attached label on the container, and said control means being for receipt of said signals from said third and said fourth sensor means.

13. The apparatus according to claim 12, wherein said inlet means comprises and inlet star wheel, said outlet means comprises an outlet star wheel and said outlet star wheel further comprises:

means for applying pressure to the container to further press the attached label onto the container, said means for applying pressure being movably mounted on said outlet star wheel, said means for applying pressure comprising a first idle position away from the container and a second engaged position in contact with the container;

cam means movably disposed on said outlet star wheel for engaging said means for applying pressure to move said means for applying pressure from said second engaged position to said first idle position;

said cam means having a first position for engaging said means for applying pressure and a second position out of engagement with said means for applying pressure;

means for moving said cam means from said first position to said second position and from said second position to said first position; and said control means for activating said means for moving said cam means so that said means for applying pressure applies pressure to the container only when the attached label is present.

14. The apparatus according to claim 13, wherein:

said means for providing relative movement comprises a turntable, said turntable comprising:

a plurality of receptacles for receipt of a container;

means for retaining the container on the receptacle, said means for retaining comprising at least one gripping head;

means for moving said at least one gripping head into and out of engagement with the container;

biasing means for maintaining engagement of said at least one gripping head with the container; and transmitter means mounted in conjunction with said gripping head so that said transmitter means has a first position when the gripping head is in engagement with the container and a second position when the container is not present; and said third sensor means further comprises said transmitter means and said transmitter means in said first position being for transmitting a signal to said control means to indicate the presence of the container and said transmitter in said second position being for not transmitting a signal to the control means to indicate the absence of the container;

the closure comprises a screw-on cap having a threaded portion;

the bottle comprises a threaded portion for receipt of the threaded portion of the screw-on cap;

said means for transporting the at least one label comprises at least one pivotable extractor element; and said apparatus further comprises:

at least one of: brushes and rollers for pressing and smoothing the at least one label onto the container; and a bottle extractor means positioned after said outlet star wheel, said bottle extractor means for removing bottles having improperly applied labels and bottles with no labels as determined by said fourth sensor means.

15. The apparatus according to claim 9, further including second and third sensor means, said second sensor means for detecting the presence of the container and said third sensor means being disposed after said at least one labelling station for detecting an attached at least one label on the container, said second sensor means for producing a signal corresponding to the presence of the container and said third sensor means for producing a signal corresponding to the presence of the attached at least one label on the container.

* * * * *